United States Patent [19]

Doyle

[11] 3,949,768

[45] Apr. 13, 1976

[54] DEVICE FOR ASSISTING IN THE CARE OF DENTURES

[76] Inventor: Barbara J. Doyle, 1224 Euclid, Santa Monica, Calif. 90404

[22] Filed: Feb. 21, 1975

[21] Appl. No.: 551,512

[52] U.S. Cl. ..... 132/84 B; 15/22 R

[51] Int. Cl.[2] ..... A45D 44/18

[58] Field of Search ..... 132/84 R, 84 B, 85; 401/125

[56] References Cited

UNITED STATES PATENTS

| | | | |
|---|---|---|---|
| 611,788 | 10/1898 | Lincoln | 132/84 R |
| 1,172,293 | 2/1916 | Kohlhepp | 401/125 |
| 1,274,697 | 8/1918 | Dynowsky | 401/125 |

*Primary Examiner*—G. E. McNeill

*Attorney, Agent, or Firm*—Robert H. Eckhoff

[57] ABSTRACT

A reusable denture kit is provided to enable a denture wearer to care adequately for a denture, to maintain it in a desired condition of cleanliness and to facilitate retention of the denture in place.

6 Claims, 6 Drawing Figures

DEVICE FOR ASSISTING IN THE CARE OF DENTURES

SUMMARY OF THE INVENTION

It is in general the broad object of the present invention to provide a denture kit which contains the essential components enabling a denture wearer to maintain a denture in a desired condition of cleanliness and to facilitate retention of the denture in place.

DESCRIPTION OF THE PREFERRED EMBODIMENT

Figure 1:
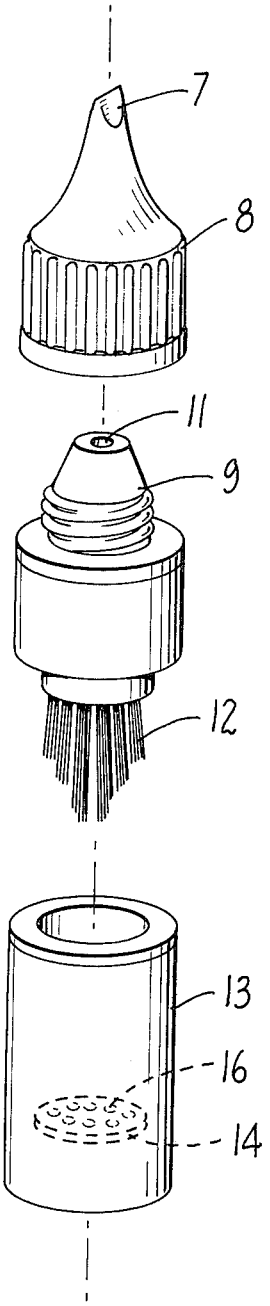
FIG. 1 is a perspective view illustrating several components of the one form of denture kit.
Figure 2:
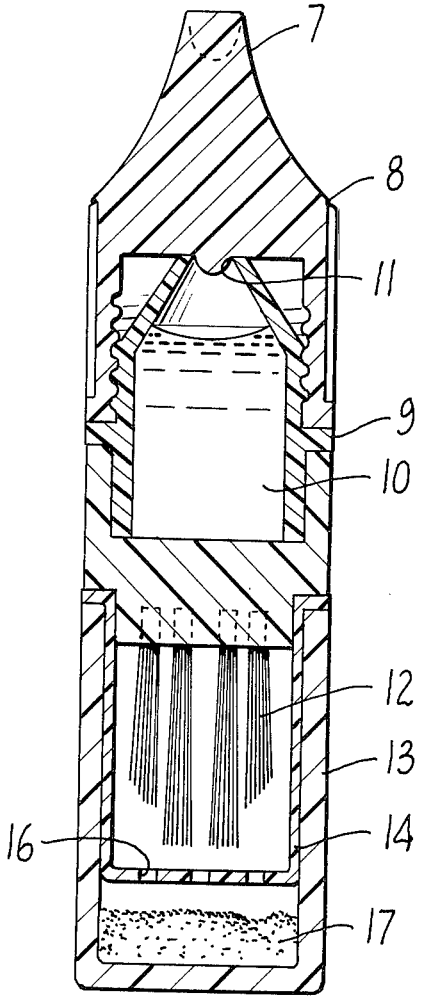
FIG. 2 is a cross section taken through the kit of FIG. 1.
Figure 3:
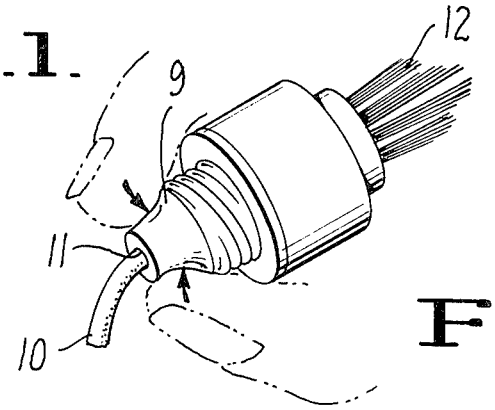
FIG. 3 is a perspective view illustrating the kit in application of FIG. 1.

Referring particularly to FIGS. 1, 2 and 3, the conical top portion 7 is provided with a flat sharpened end which can be utilized as a scraper to remove adhering denture paste from a denture. Scraper 7 is provided as a projection upon a threaded cap 8 which fits over an inner container 9 in which is placed a denture adhesive paste indicated by 10. The inner container 9 is flexible so that the paste can be forced through the upper aperture 11, as appears in FIG. 3, onto a denture. On the underside of the container 9, I provide a brush 12 which fits within bottom container 13. The bottom container is provided with a removable inner liner 14 having holes 16 therein through which a cleaning powder 17 can be displaced upon the brush 12.

Figure 4:
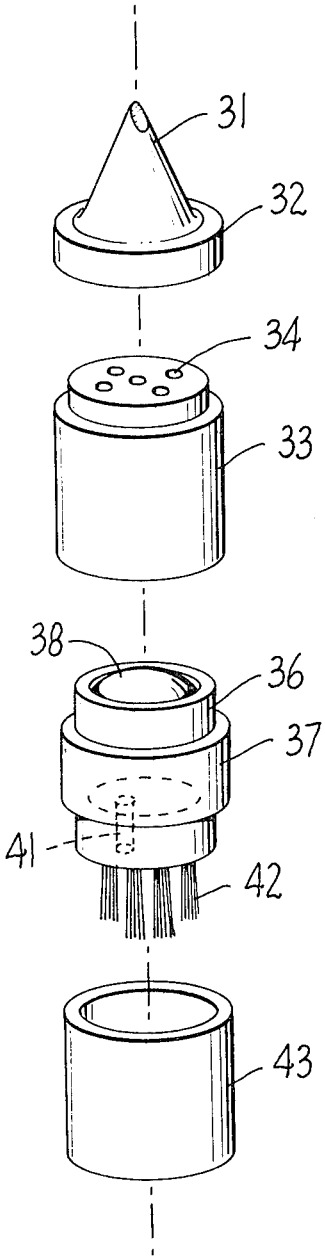
FIG. 4 is a perspective view of another form of the kit.
Figure 5:
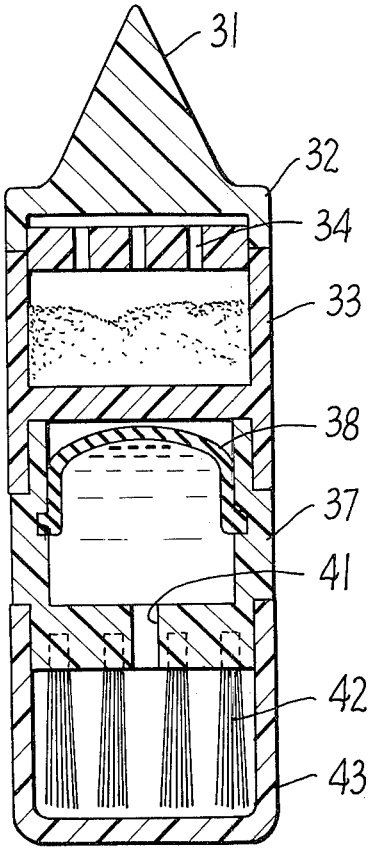
FIG. 5 is a cross section taken through the kit of FIG. 4.
Figure 6:
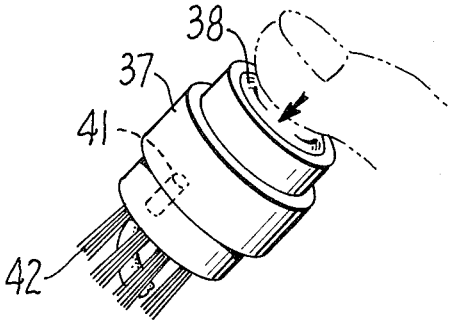
FIG. 6 is a perspective view illustrating manipulation of the kit of FIG. 4.

In that form of the invention shown in FIGS. 4, 5 and 6, scraper element 31 is provided as a projection upon cap 32, the latter fitting in frictional engagement with an end of a container 33 for an adhesive powder which is dispensed through the sieve-like structure 34. Adhesive powder container 33 fits over a rim 36 on a bottom container 37. The upper end of container 37 is closed by a flexible element 38. When depressed, element 38 forces a cleansing paste out through aperture 41 into the brush 42 which normally fits in another container 43 fitting on the end of container 37.

I claim:

1. A kit for denture care comprising:

a brush member having an axial bore in one end thereof and a bristle mounting section on the opposite end thereof;

a multiplicity of bristles mounted on said bristle mounting section and extending outwardly therefrom;

a paste container having a resilient wall held in said axial bore and having an aperture therein for dispensing said paste from said container when said resilient wall is squeezed;

powder containing means detachably held on one end of said brush member and having an apertured wall which includes a multiplicity of holes defined therein to be coaxial with said brush member for dispensing said powder from said powder containing means; and a bristle accommodating means detachably held in axial alignment with said brush member and said powder containing means on said brush member to accommodate said bristles therewithin.

2. The kit of claim 1, wherein said bristle accommodating means includes an apertured wall coaxial with said brush member and having defined therein a multiplicity of holes coaxial with and adjacent said bristles when they are accommodated in said bristle accommodating means.

3. The kit of claim 2, further wherein said powder container detachably encases said bristle accommodating means in a manner such that a chamber is formed by the inner walls of said powder container and said apertured wall for storing cleaning powder to be dispersed onto said bristles through said holes in said apertured wall when said container encased bristle accommodating means is held on said bristle mounting section with said bristles accommodated therein.

4. The kit of claim 1, further including a cap detachably secured to and coaxial with said paste container and having a scraper element for removing material from dentures.

5. The kit of claim 1, wherein said powder containing means is detachably held on said brush member to be adjacent and in axial alignment with said resilient member and includes an apertured wall coaxial with said brush member and having defined therein a multiplicity of holes coaxially arranged with respect to said brush member for dispensing powder stored in said powder containing means onto said bristles.

6. The kit of claim 5, further including a cap detachably secured to said powder container to be in axial alignment with said brush member and having a scraper element for removing material from dentures.

* * * * *